US009821361B2

(12) United States Patent
Therrien

(10) Patent No.: US 9,821,361 B2
(45) Date of Patent: Nov. 21, 2017

(54) CRIMP DIE SET

(71) Applicant: Hubbell Incorporated, Shelton, CT (US)

(72) Inventor: Peter N. Therrien, Bedford, NH (US)

(73) Assignee: Hubbell Incorporated, Shelton, CT (US)

( * ) Notice: Subject to any disclaimer, the term of this patent is extended or adjusted under 35 U.S.C. 154(b) by 357 days.

(21) Appl. No.: 14/579,632

(22) Filed: Dec. 22, 2014

(65) Prior Publication Data

US 2015/0222072 A1 Aug. 6, 2015

Related U.S. Application Data

(63) Continuation-in-part of application No. 14/209,311, filed on Mar. 13, 2014, now Pat. No. 8,997,543.

(60) Provisional application No. 61/787,449, filed on Mar. 15, 2013.

(51) Int. Cl.

| | |
|---|---|
| ***B21D 37/10*** | (2006.01) |
| ***B25B 27/10*** | (2006.01) |
| ***H01R 43/042*** | (2006.01) |

(52) U.S. Cl.

CPC ..... *B21D 37/10* (2013.01); *B25B 27/10* (2013.01); *H01R 43/042* (2013.01); *Y10T 29/49181* (2015.01); *Y10T 29/53235* (2015.01)

(58) Field of Classification Search

CPC .... B21D 37/10; B21D 51/2646; B25B 27/10; H01R 43/042; B21K 5/20; B21K 5/16

USPC ..... 72/372

See application file for complete search history.

(56) References Cited

U.S. PATENT DOCUMENTS

| | | | | |
|---|---|---|---|---|
| 2,684,003 | A | 7/1954 | Klinger | |
| 3,712,157 | A * | 1/1973 | Kratz | B21K 5/20 72/359 |
| 3,905,220 | A | 9/1975 | Sosinski | |
| 3,956,823 | A | 5/1976 | Kuo | |
| 4,126,936 | A | 11/1978 | Koller | |
| 4,277,124 | A | 7/1981 | Loose et al. | |
| 4,942,757 | A | 7/1990 | Pecora | |
| 5,084,963 | A | 2/1992 | Murray et al. | |
| 5,649,445 | A | 7/1997 | Lavoie et al. | |
| 5,778,774 | A | 7/1998 | Lavoie | |
| 5,799,525 | A * | 9/1998 | Johnson | B21D 51/2646 72/105 |
| 5,966,982 | A | 10/1999 | Mello et al. | |

(Continued)

FOREIGN PATENT DOCUMENTS

| | | |
|---|---|---|
| JP | 8111247 | 4/1996 |

OTHER PUBLICATIONS

International Search Report for Application No. PCT/US2014/026598 dated Jul. 21, 2004 (2 pages).

(Continued)

*Primary Examiner* — David B Jones
(74) *Attorney, Agent, or Firm* — Michael Best & Friedrich, LLP

(57) ABSTRACT

A die set for crimping operations includes first and second die members having raised areas including a plurality of knurls and character areas. The die set combining knurls and character areas on the operative areas of the die members allows a single die set to be used to condition a surface for crimping operations as well as crimping connectors and marking them with relevant indicia without having to change die sets.

12 Claims, 9 Drawing Sheets

(56) References Cited

U.S. PATENT DOCUMENTS

| | | | | |
|---|---|---|---|---|
| 6,079,509 | A * | 6/2000 | Bee | E21B 19/161 166/382 |
| 6,230,406 | B1 | 5/2001 | Balfour et al. | |
| 6,685,381 | B1 * | 2/2004 | Sugita | B60G 9/00 280/124.152 |
| 6,792,789 | B1 | 9/2004 | Faucher | |
| 7,493,791 | B2 | 2/2009 | Chadbourne | |
| 7,543,366 | B2 * | 6/2009 | Hu | B21K 5/16 29/458 |
| 7,685,859 | B2 | 3/2010 | Ukpai et al. | |
| 8,330,029 | B2 * | 12/2012 | Dunlop | B25G 1/102 36/59 C |
| 8,997,543 | B2 * | 4/2015 | Therrien | B21D 37/10 175/423 |
| 9,010,218 | B2 * | 4/2015 | Peterson | B21K 5/20 101/28 |
| 2008/0022749 | A1 | 1/2008 | Chadbourne | |
| 2010/0087104 | A1 | 4/2010 | Gump et al. | |
| 2010/0101379 | A1 | 4/2010 | Hofmann et al. | |
| 2011/0048096 | A1 | 3/2011 | Bradley et al. | |
| 2012/0314226 | A1 | 12/2012 | Kelly | |
| 2014/0260503 | A1 | 9/2014 | Therrien | |

OTHER PUBLICATIONS

International Written Opinion for Application No. PCT/US2014/026598 dated Jul. 21, 2004 (4 pages).

PCT/US2015/067070 International Search Report and Written Opinion dated Feb. 23, 2016.

* cited by examiner

CRIMP DIE SET

CROSS-REFERENCE TO RELATED APPLICATIONS

The present application is a continuation-in-part of U.S. Ser. No. 14/209,311 filed Mar. 13, 2014, which, in turn, claims priority under 35 U.S.C. §119(e) to U.S. Provisional Application No. 61/787,449, filed Mar. 15, 2013, the contents of both of which are hereby incorporated by reference in their entirety.

FIELD OF THE INVENTION

The present invention relates generally to a crimp die set. More particularly, the present invention relates to a crimp die set having a surface including knurls and characters and methods of using the same. Still more particularly, the present invention relates to a crimp die set that prepares a surface to be crimped and embosses or debosses an identification number thereon.

BACKGROUND OF THE INVENTION

Crimping tools using interchangeable accessory dies are known in the art. As will be appreciated by one of ordinary skill in the art, crimp die sets are used in various fields for various purposes. One particularly applicable field involves those environments when crimping is required for grounding metal surfaces. Such environments include grounding steel "I"-beams in construction and steel supports for solar panels in solar farms. Other environments include situations such as grounding steel street grates or steel ladders in sewer manholes, etc. Typically, these environments involve metal substrates having thicknesses of ⅛ inch to ⅞ inch. To these metal substrates, a grounding connector and grounding wire are crimped together. The composite is then adapted to take ground fault energy and the like from the substrate through the connector to the wire and then safely to ground.

For these types of environments, the art has developed particularized crimp die sets and methods. For example, when installing electrical connectors and ground wires to metal substrates, it is particularly imperative that the materials stay connected even under stress or otherwise the ground fault protection is lost. To this end, Underwriter's Laboratories has promulgated the UL467 Standard for grounding connectors that specifies a minimum "pull off" value. As will be appreciated, the pull off value is the amount of stress (pounds) that is required to pull the grounding member off of the metal substrate. By requiring a minimum pull off value be met, UL-approved products can help assure that grounding wires and the like stay attached to the metal substrates through the range of stresses that may be encountered in the environment, thereby maintaining the protection against ground faults.

The art generally recognizes that structural steel and other flat surfaces are often generally smooth in texture. A problem with smooth surfaces is that it is difficult to simply squeeze a connector onto the smooth surface and expect it to remain adhered under even minimal stress. To combat this adhesion problem, the art uses "knurling" dies to condition the surface of the metal substrate. "Knurling" dies are a set of dies that include a field of raised features that will deform the surface(s) of substrate under pressure to leave the surface(s) textured. Typical, the knurls (raised features) are pyramidal in shape. Knurling leaves the surface textured and thus able to form more meaningful and lasting connections when crimped together with other materials. Knurling is carried out using a crimp tool that is loaded with right and left die members (a die set). Once loaded, the crimp tool is positioned such that its jaws accept the connection area of the substrate and then operated to squeeze the metal substrate under force (up to 12 tons) between the die members. The die members in turn displace and deform the metal substrate surface with an imprint of the topography of the die member faces. Dies come in different sizes and shapes and each configuration has its own "die number." The die number is specific to the die set and is a universally recognized classification system for dies.

Notably, the connectors to be crimped to the metal substrates have been tested by UL to meet the pull off value requirement. The die index number for the die set used with the connector in passing the tests that are required for UL approval plays an important role. In order to comply with the standard, the same die number must be used in the field when crimping the connectors to substrates (to assure that the minimum pull off value is achieved).

In connection with complying with the UL standard, the instructions for most electrical connectors identify the die index to be used in crimping the connectors to the metal substrate. An issue arises when an electrical inspector is inspecting a work site and needs a way to identify if the connections are complying with the UL standard by employing the correct die index. Presently, the art has evolved to the use of a second die set having a mirror-image impression of the die index number in the face of the die members. The provision of the die number recesses in the die members allows the crimp tool to be reloaded with the second die set and activated a second time to squeeze the metal, typically copper, connectors such that the second die set members deform the metal to the point that it is accepted into the impressions during crimping, thereby embossing the die number raised and visibly discernible on the connector body after crimping. An inspector can then visually see the die index number and confirm that the correct die set was used in crimping the grounding connector and wire to the metal substrate sufficient to meet the UL standard during his inspection.

As will be appreciated, the current state of the art of crimp tool dies for grounding operations uses two separate die sets to perform the crimping operation. The first die set is used to prepare the surface. The second die set in turn crimps the connector to the surface and embosses a die index number thereon. The process of loading the crimp tool with a first die set to condition the surface of the substrate and engaging the substrate, then removing the tool from the substrate, loading a second die set, repositioning the tool and a connector/wire assembly, and then crimping the connector/wire assembly and substrate together (and leaving a visible die index number on the surface) is time consuming.

Additionally, as will be appreciated, the cost of knurling dies and separate die index dies is expensive as an installer must purchase two crimp die sets for each crimp size, thereby increasing costs and inventory. Not only is additional time required to conduct the crimp operation in switching between the two different crimp die sets, an improper size second die set can accidentally be used, thereby resulting in a poor crimp.

The foregoing highlights some of the problems with conventional crimp die sets. Furthermore, the foregoing highlights the long-felt, yet unresolved need in the art for a crimping method that can be used more quickly and efficiently to meet the requirements for crimping operations in the field. In addition, the foregoing highlights the inventor's recognition of a need in the art for a crimp die set that prepares a crimping surface and embosses an identification number thereon.

SUMMARY OF THE INVENTION

Various embodiments of the present invention overcome various of the aforementioned and other disadvantages associated with prior art crimp die set and methods, and offers new advantages as well.

According to one aspect of various embodiments of the present invention, there is provided a crimp die set that reduces inventory.

According to another aspect of various embodiments of the present invention, there is provided a crimp die set that quickens a crimping operation.

According to yet another aspect of various embodiments of the present invention there is provided a single crimp die set or a pair of dies that both prepares a crimp surface and embosses an identification number thereon., These aspects and other advantageous features of various embodiments of the present invention may be realized by the provision of what the present inventor terms a "combocrimp" die set. In one preferred embodiment, the combocrimp die set comprises a pair of cooperating die members adapted to fit in and be operable with standard-sized crimp tools.

In accordance with a first preferred embodiment, the die members comprise a first die member and a second die member having operative surfaces including knurls. In some preferred embodiments, the die members are configured in the same shape and comprises the same materials as prior art die members with the difference being confined to the knurl surface. According to an advantageous feature of this embodiment of the invention, the knurls are disposed in a generally waffle-pattern (similar to that of existing knurl dies) that further includes "character" areas of numbers, symbols, or patterns defined in the knurl area.

Preferably, the character areas of numbers, symbols, or patterns comprise raised areas or ridges of appropriately shaped knurl peaks (or other ridges) suited to deboss the numbers, symbols, or patterns on a substrate, such as an electrical connector and ground wire assembly, crimped between the die members. In one embodiment, the peaks of the raised areas are coterminous with the peaks of the knurls. An advantageous feature of the invention is that the raised areas can be included on one, or preferably both, die members. In an alternate and presently preferred embodiment, instead of raised areas or ridges, the character areas may comprise depressed areas or recesses similar to those of prior art crimping dies to emboss die index numbers on connectors.

In accordance with a second preferred embodiment, the die members comprise a first die member and a second die member, wherein at least the first die member includes a first operative area comprising knurls and a second operative area comprising a character area. The first and second operative areas may be physically separate areas, such as separate raised areas, or part of the same contiguous area.

In accordance with some embodiments of the invention, both the first and second die members include first and second operative areas, wherein the first operative areas comprise knurls and the second operative areas comprise character areas. Preferably, the first and second operative areas of respective die members are mirror images of one another. in presently preferred embodiments, the character area(s) includes recesses defining a die index number, or other letter, symbol, etc. Alternatively, the character area(s) may comprises knurls or ridges defining a die index number, or other letter, number, symbol, etc. Preferably, the character(s) is defined in a pattern which is the mirror image of the desired character(s) so the character(s) will be embossed or debossed on the surface of a substrate and oriented correctly in the final product.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

As used in this application, the terms "front," "rear," "upper," "lower," "upwardly," "downwardly," and other orientational descriptors are intended to facilitate the description of the exemplary embodiment of the present invention, and are not intended to limit the structure of the exemplary embodiment of the present invention to any particular position or orientation.

BRIEF DESCRIPTION OF THE DRAWINGS

Various aspects and advantageous features of embodiments of the present invention will become more apparent to those of ordinary skill when described in the detailed description of a preferred embodiment and reference to the accompany drawing wherein.

Throughout the drawings, like reference numerals will be understood to refer to like parts, components and structures.

DETAILED DESCRIPTION

While the present invention will be described in connection with embodiments suited for the operation of crimping copper electrical connectors and wires to steel substrates using a hand-operated, hydraulic crimp tool, it will be readily apparent to one of ordinary skill in the art armed with the present specification that the present invention can be modified and applied to any suitable crimping operating or the like in any suitable environment. For example, as clear from the exemplary embodiments below, various of the advantageous aspects of the invention described herein may be incorporated into any suitable die configuration, including, but not limited to, the U-style and K-style die sets shown in the Figures. The present invention should not be deemed limited to specific styles or types of dies.

Figure 1:
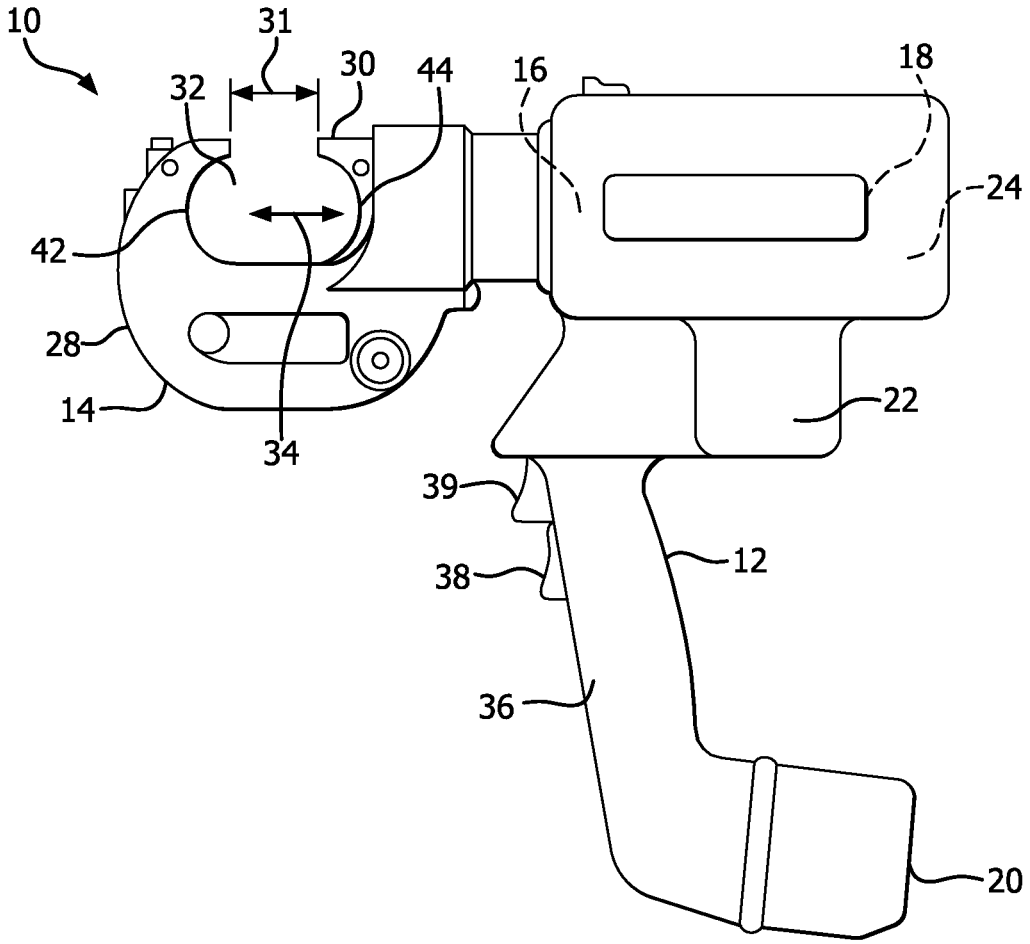
FIG. 1 PRIOR ART
FIG. 1 is a side elevational plan view of a conventional crimp tool utilizing "U" style dies.
Figure 2:
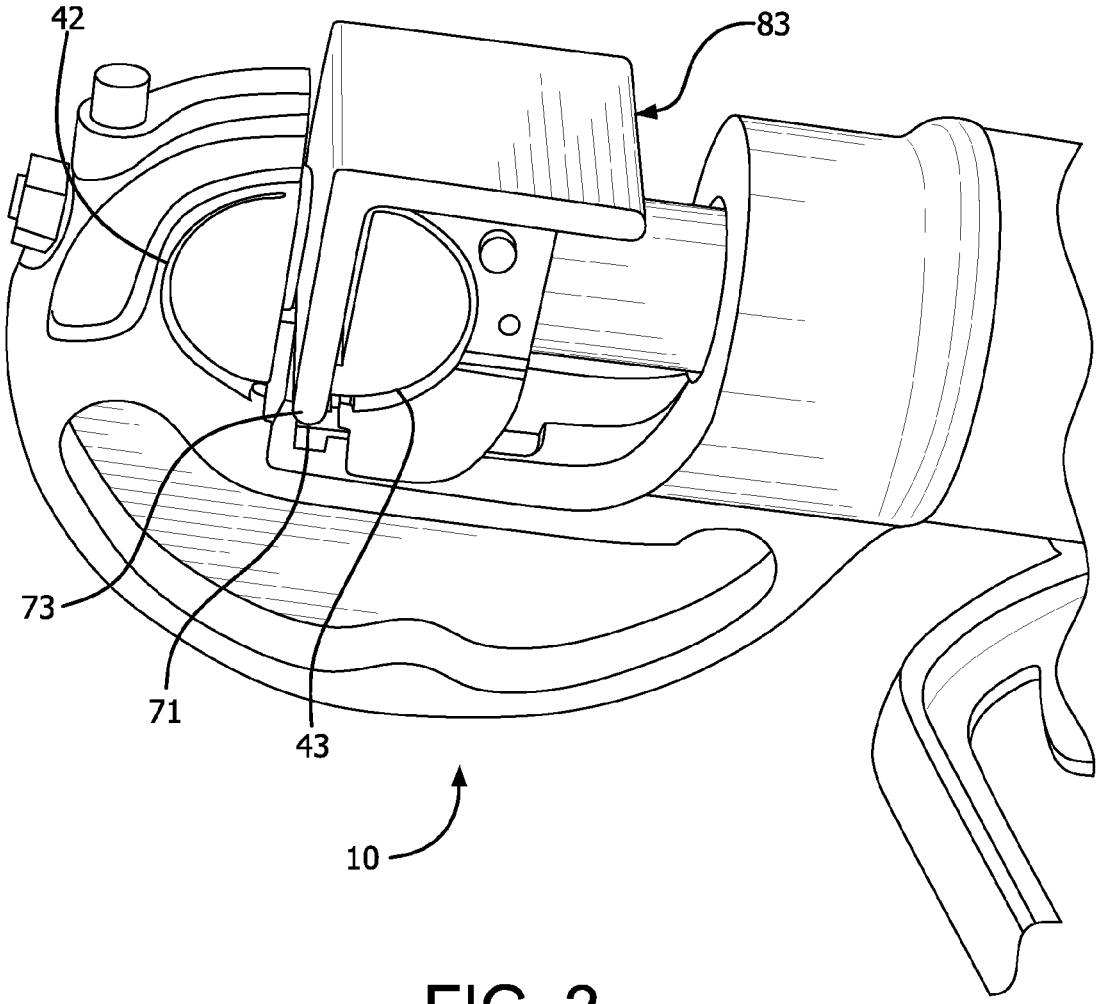
FIG. 2 PRIOR ART
FIG. 2 is a perspective view of a first die set, or knurling die set, used with the U-style crimp tool of FIG. 1 to prepare a surface for crimping.
Figure 3:
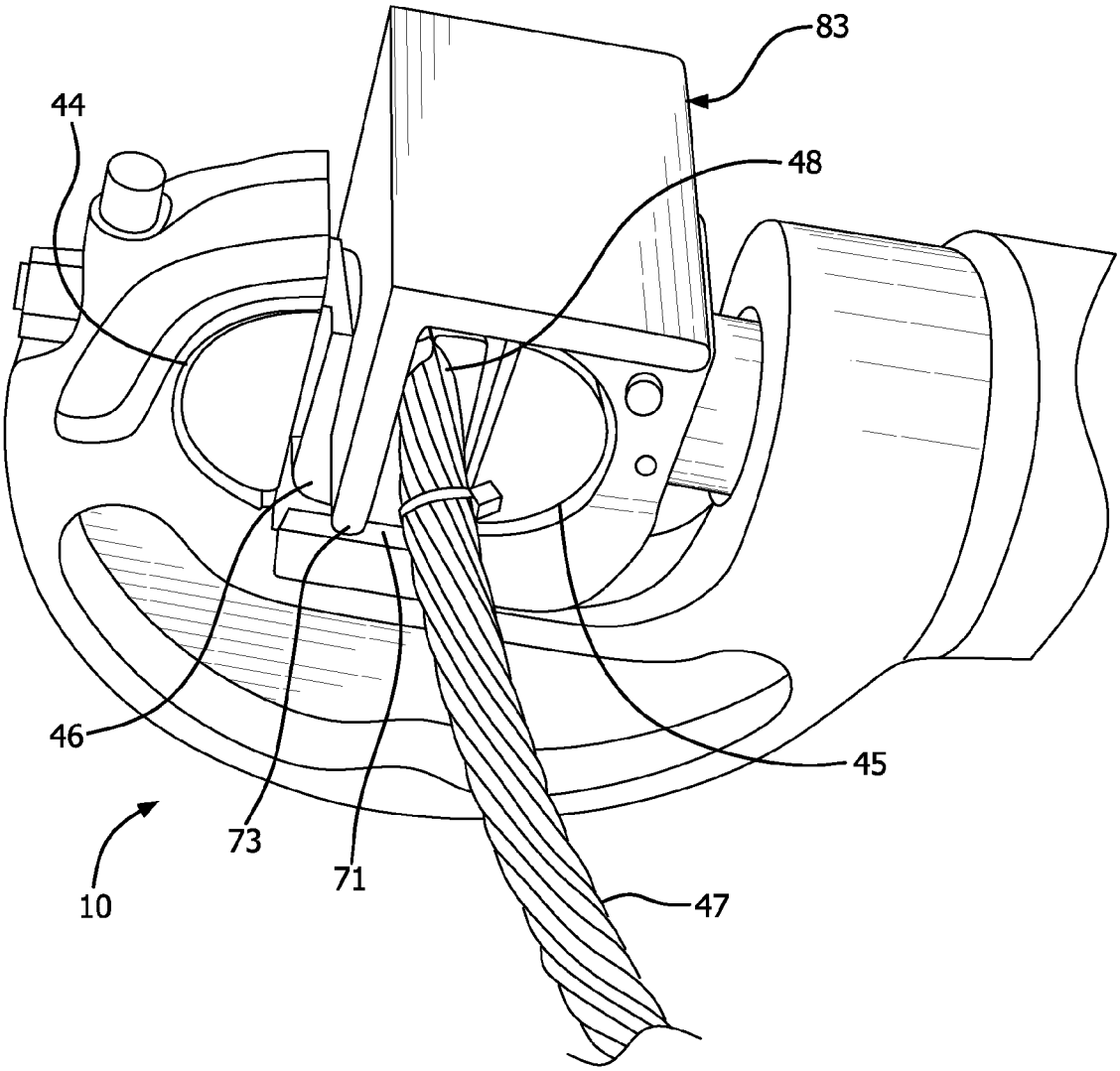
FIG. 3 PRIOR ART
FIG. 3 is a perspective view of a second die set used with the crimp tool of FIG. 1 to crimp a connector to the prepared surface and emboss the die index number thereon.

Turning to the Figures, for context in describing preferred embodiments of the present invention, a crimp tool and crimping dies commonly used in installing electrical connectors is depicted in FIGS. 1-3. As shown in FIG. 1, a conventional crimping tool 10 includes a frame 12, a working head 14, a pump 16, a motor 18, a battery 20, a fluid reservoir 22 and a controller 24. The tool can also include additional or alternative components. The frame 12 forms a ram hydraulic drive conduit system. The working head 14 comprises a frame section 28 and a ram 30. The frame section 28 is stationarily connected to the front end of the frame 12, but could be rotatable. The ram 30 is movably connected to the section 28. The section 28 and the ram 30 are adapted to removably receive conductor knurling and crimping dies at a conductor receiving area 32.

The ram 30 moves forward and backward axially as indicated by arrow 34. The ram hydraulic drive conduit system is connected between the pump 16 and the rear end of the ram 30. Hydraulic fluid pumped by the pump 16 against the rear end of the ram 30 causes the ram 30 to move forward. A spring (not shown) returns the ram 30 to its rearward home position when hydraulic fluid pressure is released. The ram 30 moves a distance 31 between its rear position and its forward position.

The frame 12 forms a handle 36. The battery 20 is removably connected to the bottom of the handle 36. The handle 36 includes two user actuatable control triggers 38 and 39, which are operably coupled to the controller 24.

The motor 18 is coupled to the controller 24 and the battery 20. The motor 18 is controlled by the controller 24. The output shaft of the motor 18 is connected to the pump 16 by a gear reduction or gearbox.

When crimping an electrical wire crimp connector to a surface, a two step process is required. First, the surface 41, such as a steel or solid surface area, is disposed between a first die set 42 and 43, known as "knurling dies", as shown in FIG. 2. The first die set 42 and 43 has knurls to prepare the surface 41 for the subsequent crimp connection.

As shown in FIG. 3, the first die set 42 and 43 is removed and replaced with a second die set 44 and 45, or "crimping dies." The prepared surface 41 is disposed in a crimp connector 46 such that both surfaces of the prepared surface 41 engage a surface of the crimp connector 46. An electrical wire 47 is disposed in an opening 48 in the crimp connector 46. The surface 41, the crimp connector 46 and the electrical wire 47 are crimped together using the second die set 44 and 45. The second die set 44 and 45 include recesses in the form of the die index number for the die set. The recesses serve to emboss the die index number on the crimp connector 46 to ensure proper tooling was used in the operation as required by UL.

As clear from the above, the accepted method of crimping grounding connectors and the like in the field is a multi-step process. In particular, the need to change die sets in mid-operation to ultimately emboss the die index number on the connector is particular time-consuming, and apt to lead to mistakes wherein an improper size second die set is accidentally be used, thereby resulting in a poor, non-compliant crimp.

The present inventor recognized a need in the art for an improved process for crimping. A crimp die set, referred to as the "combocrimp" die set, that uses a single die set for a crimping operation may be configured in multiple ways. In accordance with a first exemplary embodiment of the present invention shown in FIGS. 4-7, the crimp die set includes a single operative area having knurls and character areas defined therein. In accordance with a second exemplary embodiment of the present invention shown in FIGS. 8-11, the crimp dies set includes separate knurl and character areas. Although the present invention will be described with reference to the exemplary embodiments shown in FIGS. 4-7 and FIGS. 8-11, it should be understood that the present invention can be embodied in alternative embodiments. For example, any suitable size and shape for the dies can be used. One of ordinary skill in the art armed with the present specification can modify the configuration of the die members to suit them for their intended purpose. Furthermore, while FIGS. 4-7 depict a U-style die and FIGS. 8-11 depict a K-style die, the various configurations of the operative surfaces, knurls, ridges, flat areas, and/or recesses should not be deemed limited to the configurations and positions shown. A U-style or other die style may make use of separate operative surfaces and a K-style or other style die may make use of a singular, integrated operative surface. The following description should be understood to be modifiable into any suitable configuration and not limited to any specific configurations for U-style, K-style, or any other style die set.

Turning to the first embodiment of FIGS. 4-7, the combocrimp die set comprises first and second U-style die members 51 and 52 that are adapted to be removably mounted to the frame section 28 and the ram 30 at opposing locations 42 and 44 of the conventional U-style crimp tool 10 depicted in FIG. 1. The two locations 42 and 44 form die mounting areas of the crimp tool 10 for removably mounting the dies 51 and 52 to the crimp tool. The dies 51 and 52 can be mounted to any suitable type of tool such as, but not limited to, a non-battery operated tool or a non-hydraulic tool. The first and second dies 51 and 52 are each preferably unitarily formed as a single piece and are made of steel as with prior art die members. However, any suitable material or fabrication method may be used, and such variations are well within the ability of one of ordinary skill in the art.

Figure 4:
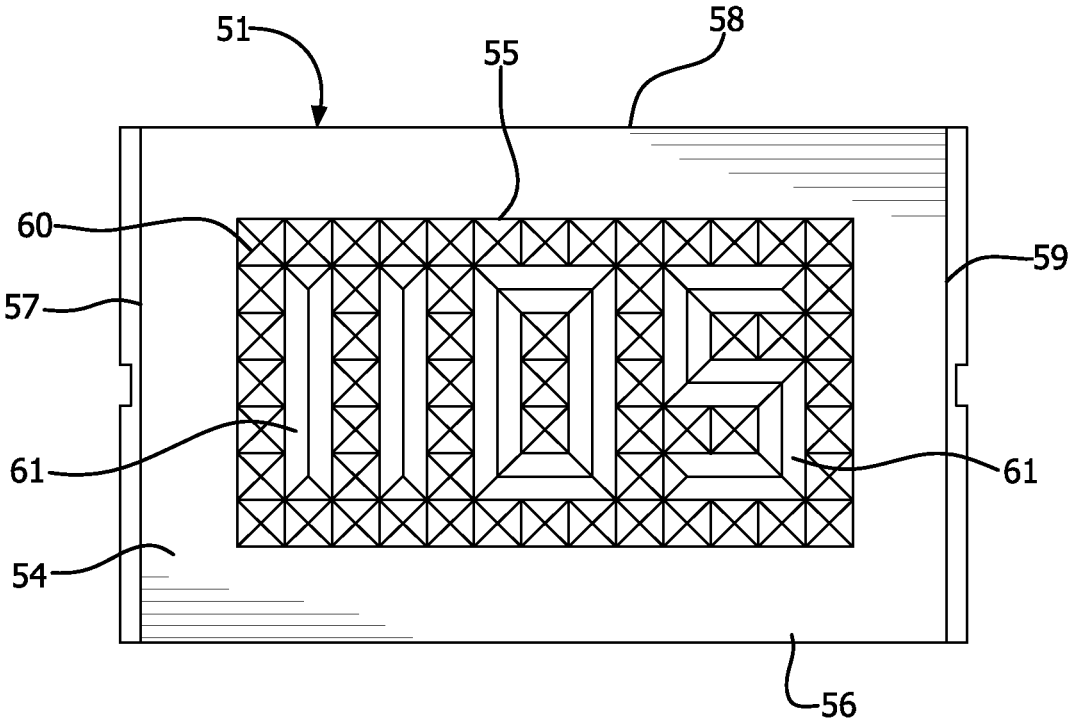
FIG. 4 is a top plan view of a first die of a U-style combocrimp die set in accordance with an exemplary embodiment of the present invention.
Figure 5:
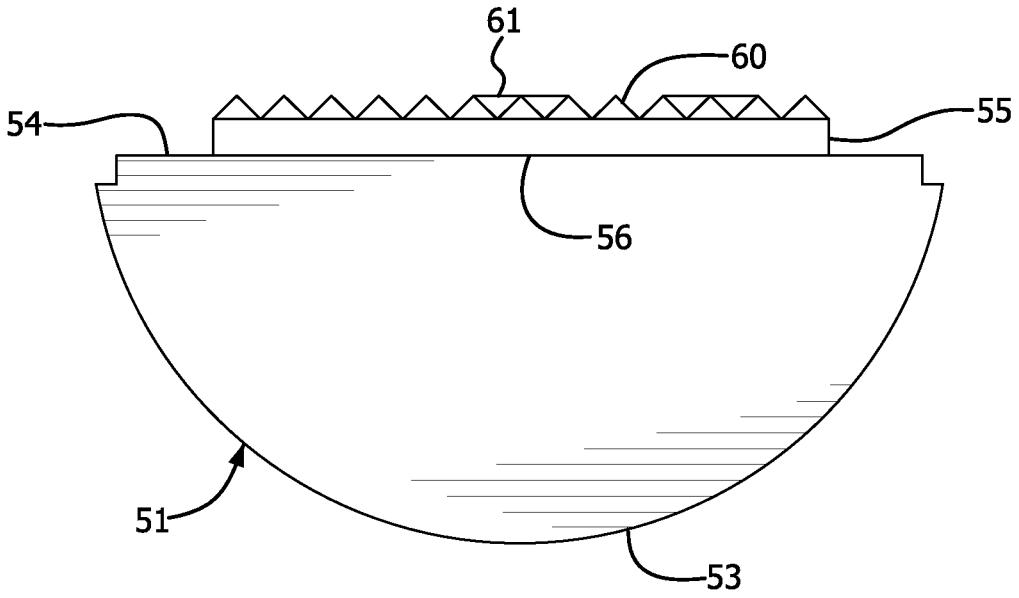
FIG. 5 is a side elevational view of the first die of FIG. 4.

The first die 51 of the combocrimp die set is shown in FIGS. 4 and 5 and has a substantially semi-cylindrical shape. A rounded surface 53 of the first die 51 is received at location 42 of the crimp tool 10 of FIG. 1. A planar surface 54 of the first die 51 has a raised platform 55, which is spaced inwardly from edges 56-59 of the first die 51.

The raised platform 55 includes a plurality of knurls 60 and reference character areas 61. The knurls 60 are preferably substantially pyramid shaped, although any suitable shape can be used. As shown in FIG. 4, the reference character 61 is "1105." The reference character preferably corresponds to a recommended die index number for the crimp connector.

As depicted, the reference character area 61 comprises raised ridges in the pattern of the reference character "1105." With this configuration, the raised ridges serve to condition the surface as well as stamp the surface with the character. In alternate embodiments, the character areas 61 may comprises recesses defined by knurls (or the absence thereof). For example, knurls may surround the areas thereby defining a character. Alternatively, the raised platform 55 may include an etched area defining the character for embossing the character on a substrate.

Figure 6:
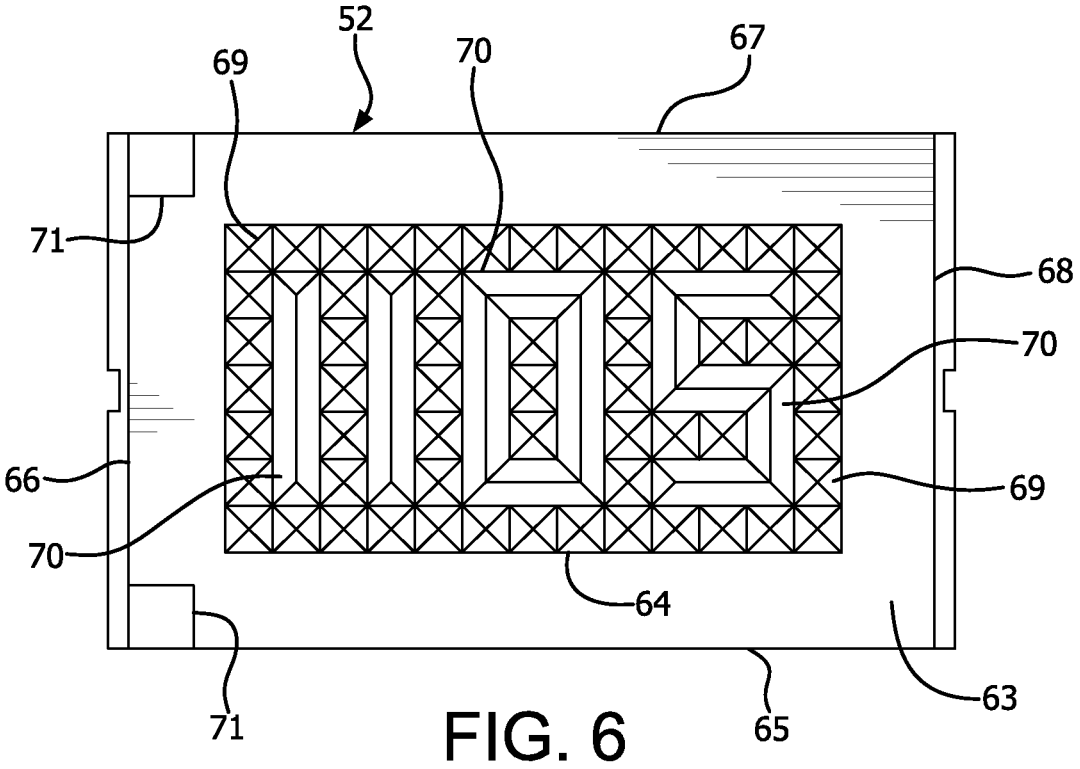
FIG. 6 is a top plan view of a second die of the U-style combocrimp die set in accordance with an exemplary embodiment of the present invention.
Figure 7:
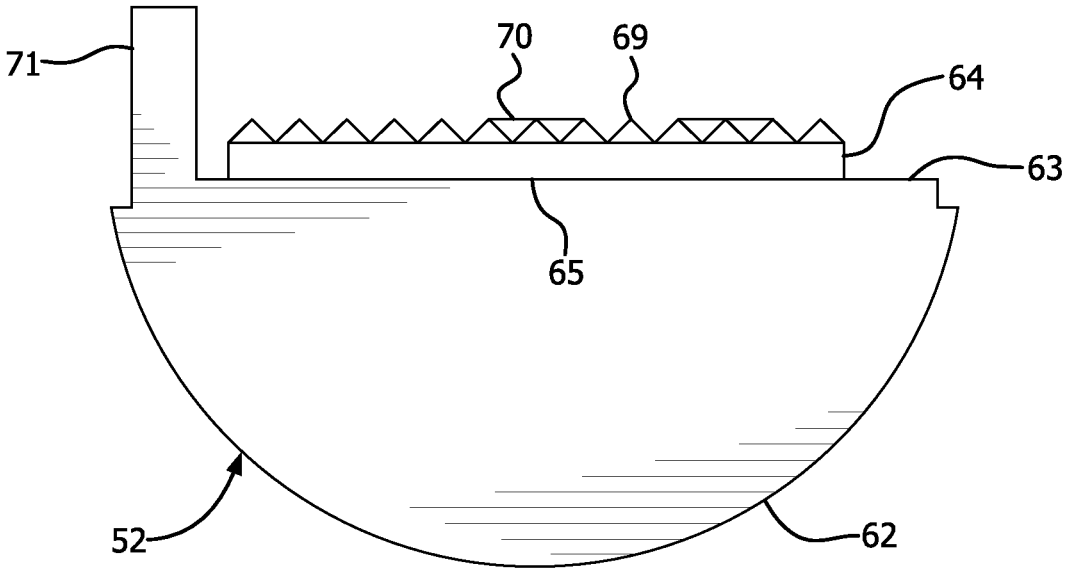
FIG. 7 is a side elevational view of the second die of FIG. 6.

The second die 52 of the crimp die set is shown in FIGS. 6 and 7 and has a substantially semi-cylindrical shape. A rounded surface 62 of the second die 52 is received at location 44 of the crimp tool 10 of FIG. 1. A planar surface 63 of the second die 52 has a raised platform 64, which is spaced inwardly from edges 65-68 of the second die 52.

Similar to the first die member, the raised platform 64 of the second die member preferably includes a plurality of knurls 69 and reference character areas 70. The knurls 69 are preferably substantially pyramid shaped, although any suitable shape can be used. As shown in FIG. 6, the reference character 70 is "1105." As depicted, the reference character area comprises raised ridges in the pattern of the reference character. With this configuration, the raised ridges serve to condition the surface as well as stamp the surface with the character. In alternate embodiments, the character areas 70 may comprises recesses defined by knurls (or the absence thereof). For example, knurls may surround the areas thereby defining a character. Alternatively, the raised platform 64 may include an etched area defining the character for embossing the character on a substrate. The reference character preferably corresponds to a recommended die index number for the crimp connector and corresponds to the reference character of the first die 51.

A pair of posts 71 extend upwardly from the planar surface 63 of the second die 52 at opposite ends of the second edge 66. The posts 71 are engaged by an edge 73 of the surface 41 to facilitate proper alignment of the surface 41, as shown in FIG. 2. As shown in FIGS. 2 and 3, the surface 41 is one leg of a substantially L-shaped bracket 83.

To crimp the connector 46 to the surface 41 of the bracket 83, the first and second dies 51 and 52 are connected to the crimp tool 10 in any suitable manner. The surface 41 is then disposed between the first and second dies 51 and 52, and the crimp tool 10 is operated, as shown in FIG. 2, for the surface preparing step. The knurls 61 and 69 displace material on opposite surfaces of the surface 41 to prepare the surface for the crimping step. The reference characters 62 and 70 of the first and second dies 51 and 52 further displace material on the surface 41.

The prepared surface 41 is then disposed in a crimp connector 46 to which an electrical wire 47 is loosely connected, as shown in FIG. 3, for the crimping step. The first and second die sets 51 and 52 remain in the tool 10 for the crimping procedure. The knurled areas of the surface 41 facilitate having the crimp connector 46 crimped thereto. Operating the crimp tool 10 crimps and secures the connector 46 and electrical wire 47 and crimps and secures the connector 46 and the surface 41 of the substantially L-shaped bracket 83. The entire raised platforms 55 and 64 of the first and second dies 51 and 52 act as the crimping surface during the crimping step. The reference characters 62 and 70 of the first and second dies 51 and 52 emboss the reference characters onto surfaces of the crimp connector 46. Preferably, the reference characters 62 and 70 correspond to a recommended die index number displayed on the crimp connector 46. Accordingly, during an inspection, it can be quickly and easily determined whether the appropriate die set was used by comparing the embossed characters crimped onto the connector with the recommended die index number displayed thereon.

Turning to the second embodiment depicted in FIGS. 8-11, the combocrimp die set of this embodiment comprises a K-style die set. As will be appreciated, the body 511 of the die 510 of the die set is generally block shaped and includes a rectangular top portion 512 and a semicircular bottom section 513. Extending from the back of the body 511 is a mounting pin 514 adapted to be received and locked into place in a K-style crimp tool (not shown). Once positioned in the jaws of a crimping tool, the dies perform the same functions as that of other dies.

The K-style die set of FIGS. 8-11 comprises at least a first (and/or second) die member 510 that is largely, operationally similar to the U-style die members of the embodiment of FIGS. 4-7 with the exception that the character areas 520 are separate from the knurl area 530. Both areas 520, 530 may be contained on a single raised operative surface 540, or physically separated in separate raised operative surfaces. Any configuration that allows the knurls 531 to condition the surface of a substrate while also allowing the characters 521 to be embossed or debossed onto a substrate should be understood to be part of the present invention.

Figure 8:
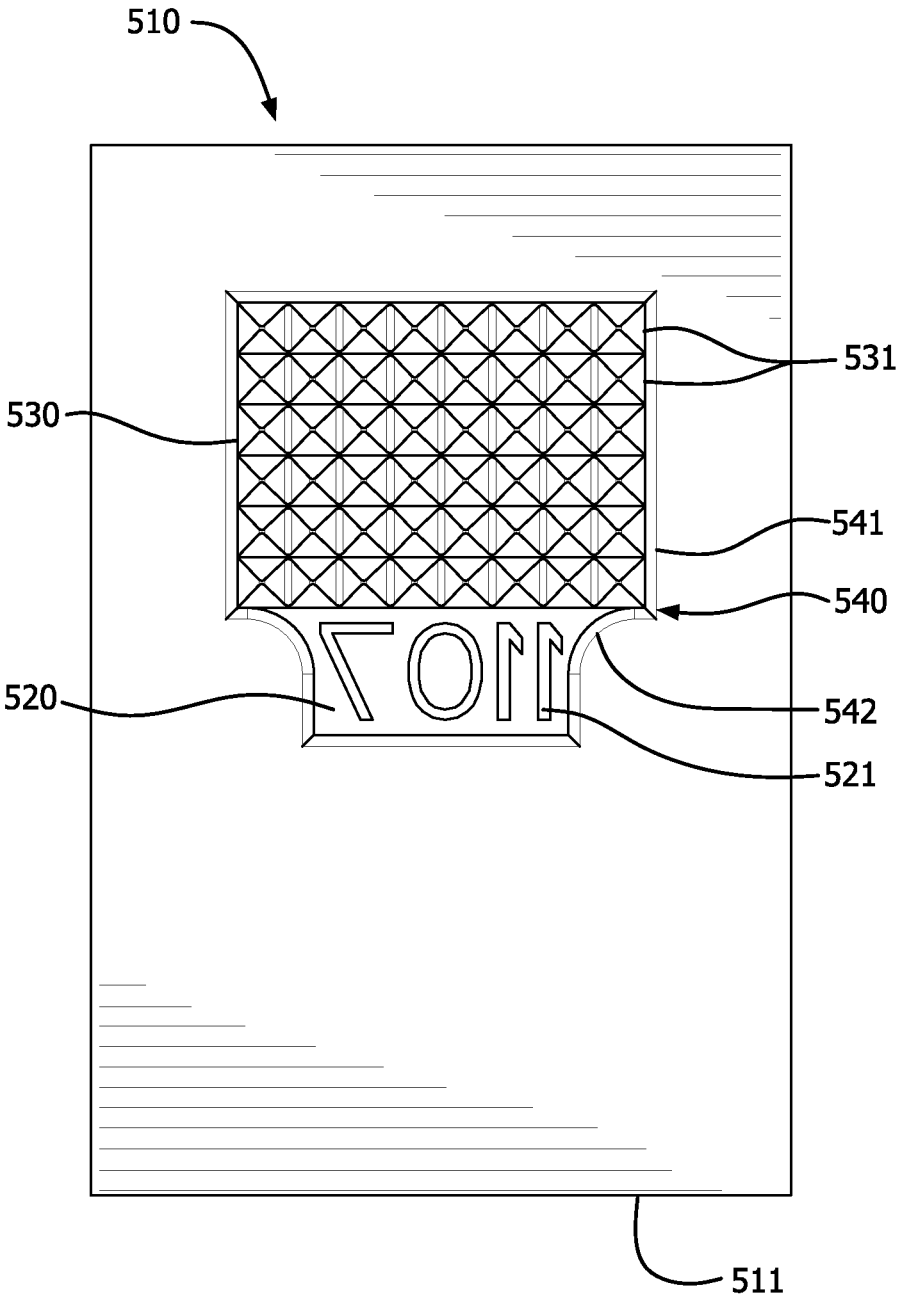
FIG. 8 is a front view of an embodiment of a K-style die member of a second embodiment of the combocrimp die comprising a "K" style die set having a first operative area comprising knurls and a second operative area having character areas.
Figure 9:
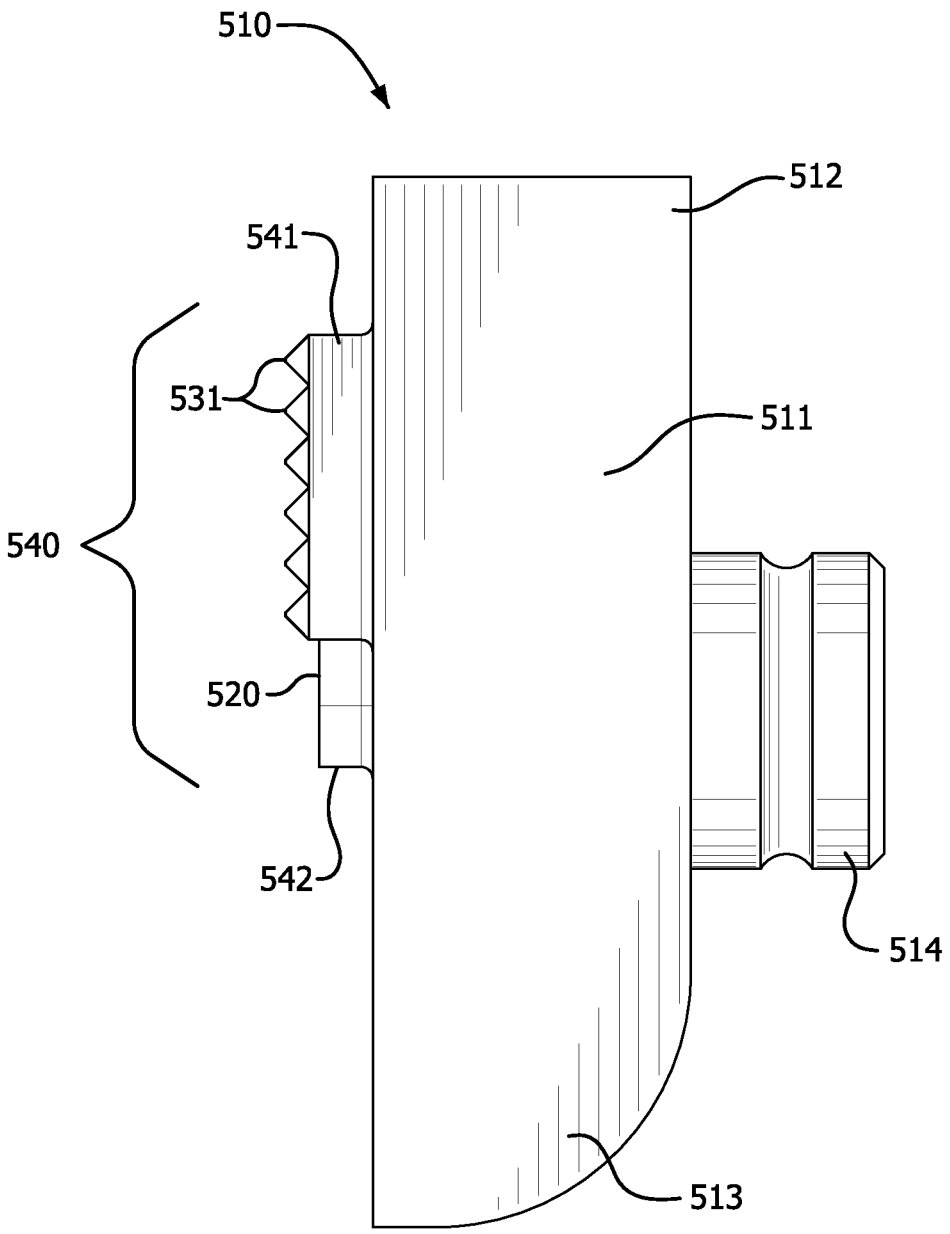
FIG. 9 is a side view of the die member of FIG. 8.
Figure 10:
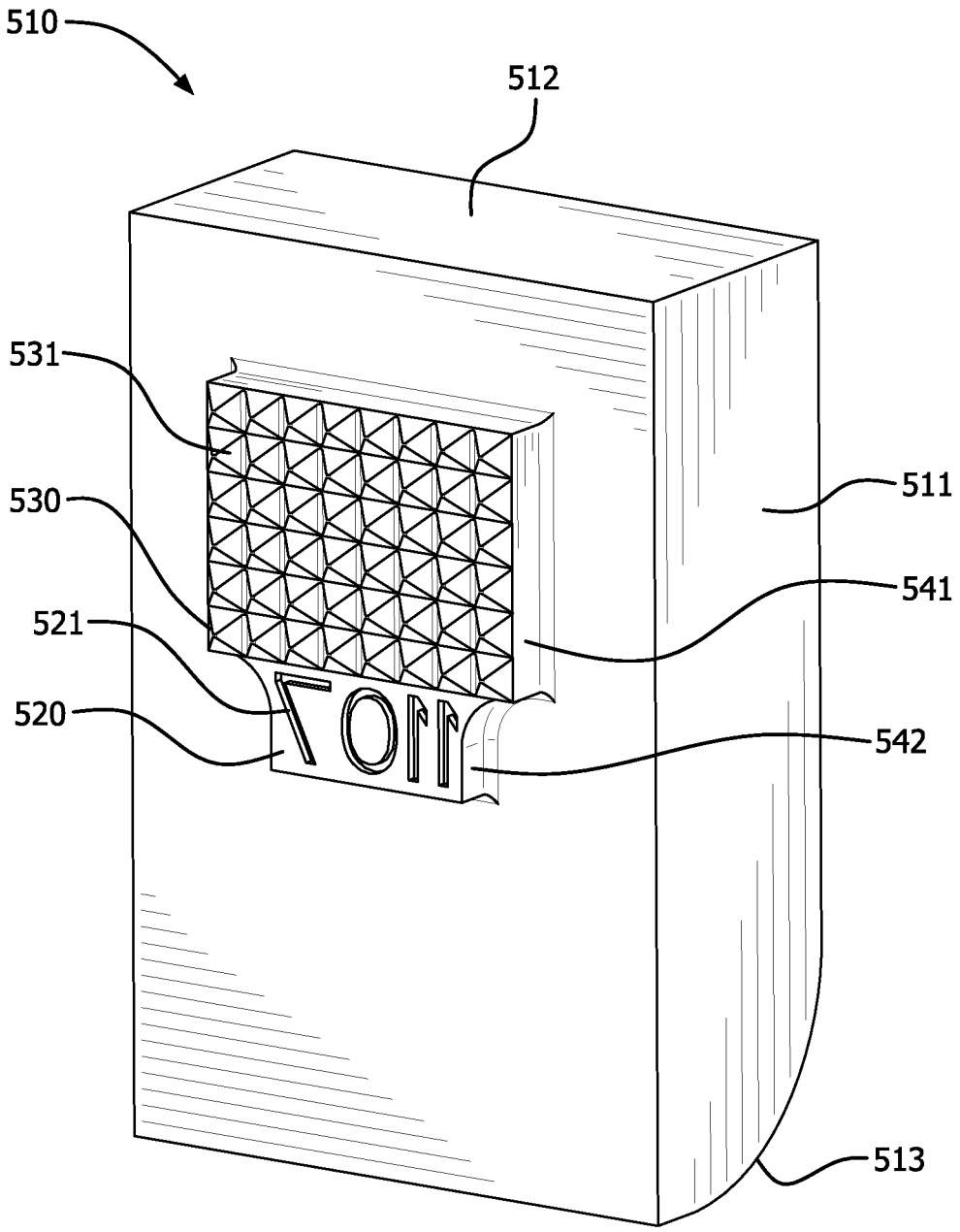
FIG. 10 is a front perspective view of the die member of FIGS. 8.
Figure 11:
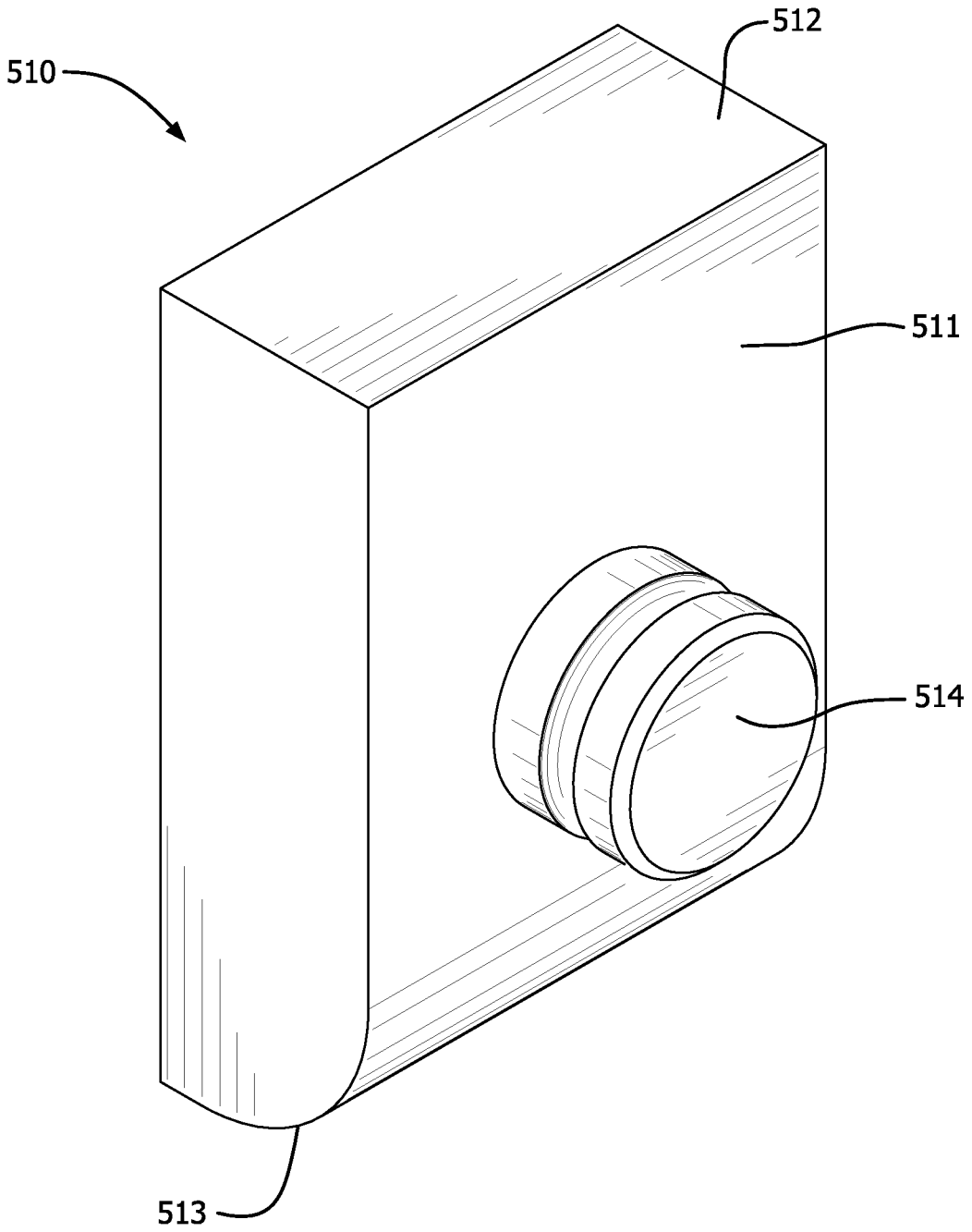
FIG. 11 is a back perspective view of the die member of FIG. 8.

As best shown in FIGS. 8 and 9, the knurl area 530 and character area 520 are confined to separate upper 541 and lower 542 areas of a raised operative surface 540. According to a presently preferred embodiment, the knurl area 530 defines the upper area 541 of the operative surface 540 and contains a waffle pattern comprised of standard, pyramidal knurls 531. The lower area 542 of the raised operative surface 540 defines the character area 520. In the depicted embodiment, the character area 520 includes recessed areas defining characters 521. As shown, the characters 521 are the mirror image of the die index number "1107." As will now be readily appreciated, during the crimping operation, the die number 1107 will be embossed onto the surface of the substrate.

While the depicted embodiment shows a presently preferred die member 510 having characters 521 defined by recesses, an alternative configuration using raised ridges or knurls may be used to deboss the die number onto the substrate's surface.

Similar to the above embodiments, other die styles, shapes, and forms may be used in carrying out various advantageous features of the present invention.

In accordance with the exemplary embodiments of the present invention discussed above, and all other suitable embodiments, the same die set can be used to prepare the surface for crimping and for crimping the connector to the prepared surface. The inventory of required crimp die sets is reduced, and the ease and speed with which the crimping operation can be performed is increased.

While advantageous embodiments have been chosen to illustrate the invention, it will be understood by those skilled in the art that various changes and modifications may be made therein without departing from the scope of the invention. The above embodiments are for illustrative purposes and are not intended to limit the scope of the invention or the adaptation of the features described herein to particular tools. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

I claim:

1. A die set for crimping operations comprising:

a first die member comprising a die body having an upper operative surface and a lower operative surface;

a plurality of knurl members disposed on said upper operative surface; a character area defined by said lower operative surface, said character area defining at least one reference character; and, a second die member.

2. The die set of claim 1, wherein said character area includes recesses that define said at least one reference character.

3. The die set of claim 1, wherein said character area includes ridges that define said at least one reference character.

4. The die set of claim 3, wherein said knurl members and said character ridges have the same height.

5. The die set of claim 1, wherein said second die member has at least one operative surface and a plurality of knurl members disposed on said operative surface.

6. The die set of claim 5, wherein said second die includes a second operative surface including character areas defining a reference character.

7. The die set of claim 6, wherein said reference character of said first and second die members define the same reference character.

8. The die set of claim 7, wherein said reference characters of said first and second die members comprise a die index number.

9. The die set of claim 1, further comprising a second die member; each of said die members having a generally block-shaped body having a rectangular top end and a semicircular bottom end; said body having a mounting pin on a back surface; and, said body having a raised platform defining said operative surface having said upper operative surface including said knurls and said lower operative surface including said character area.

10. The die set of claim 1, wherein said die set is configured for deployment in a crimp tool and operative to condition a surface for crimping and for crimping a connector to said conditioned surface while also embossing or debossing a die index number on said connector.

11. The die set of claim 1, wherein said knurls are generally pyramid shaped.

12. A method of crimping workpieces together comprising:

loading a crimp tool with die set members including opposing operative surfaces having a plurality of knurls in a first operative area and at least one character area in a second operative area;

positioning a portion of said substrate in the jaws of the crimp tool between the operative areas of the die set members;

actuating the crimp tool to close the jaws and engage the operative areas of said die set members to condition said substrate surface; loosening the jaws and inserting a connector body and wire member into engagement with said substrate;

actuating the crimp tool a second time to crimp the connector body and wire member to said substrate, whereby said crimping leaves the mirror-image of said character areas on said connector body.

* * * * *